US009840808B2

(12) United States Patent
Facey

(10) Patent No.: US 9,840,808 B2
(45) Date of Patent: Dec. 12, 2017

(54) MULTIPLE LAYER WIRE STRAND

(71) Applicant: GRIPPLE LIMITED, Sheffield (GB)

(72) Inventor: Hugh David Facey, Sheffield (GB)

(73) Assignee: GRIPPLE LIMITED (GB)

( * ) Notice: Subject to any disclaimer, the term of this patent is extended or adjusted under 35 U.S.C. 154(b) by 480 days.

(21) Appl. No.: 14/379,446

(22) PCT Filed: Feb. 13, 2013

(86) PCT No.: PCT/GB2013/000057
§ 371 (c)(1),
(2) Date: Aug. 18, 2014

(87) PCT Pub. No.: WO2013/128149
PCT Pub. Date: Sep. 6, 2013

(65) Prior Publication Data

US 2015/0033694 A1 Feb. 5, 2015

(30) Foreign Application Priority Data

Feb. 27, 2012 (GB) ..... 1203333.8
May 17, 2012 (GB) ..... 1208693.0
Feb. 11, 2013 (GB) ..... 1302325.4

(51) Int. Cl.
*D07B 1/06* (2006.01)
*D07B 1/14* (2006.01)

(52) U.S. Cl.
CPC ..... *D07B 1/06* (2013.01); *D07B 1/0693* (2013.01); *D07B 1/148* (2013.01); *D07B 1/0633* (2013.01);
(Continued)

(58) Field of Classification Search
CPC ..... D07B 1/06; D07B 1/066; D07B 1/0693
See application file for complete search history.

(56) References Cited

U.S. PATENT DOCUMENTS 4,051,661 A 10/1977 Leprohon, Jr. et al.
4,651,513 A 3/1987 Dambre
(Continued)

FOREIGN PATENT DOCUMENTS

JP 08-170282 7/1996
JP 9-209281 8/1997
(Continued)

OTHER PUBLICATIONS

Anonymous, "Micro-alloyed steel cord constructions for tyres", Research Disclosure, Mason Publications, Hampshire, GB, vol. 349, No. 84, May 1, 1993.
(Continued)

*Primary Examiner* — Shaun R Hurley
(74) *Attorney, Agent, or Firm* — Clark Hill PLC; James R. Foley

(57) ABSTRACT

A wire strand (10) comprises a plurality of wires (12, 16, 20). The wires comprise a central king wire (12), a first layer (14) of wires (16) arranged around the king wire, and a second layer (18) of wires (20) arranged around the first layer. The king wire is formed of steel having a carbon content of at least 0.3 wt %. Each wire of the first layer is formed of steel having a carbon content which is less than the carbon content of the king wire. Each wire of the second layer is formed of steel having a carbon content which is greater than, or the same as, the carbon content of the wires of the first layer.

20 Claims, 4 Drawing Sheets

(52) U.S. Cl.
CPC ..... *D07B 2201/204* (2013.01); *D07B 2201/2011* (2013.01); *D07B 2201/2012* (2013.01); *D07B 2201/2013* (2013.01); *D07B 2201/2036* (2013.01); *D07B 2201/2037* (2013.01); *D07B 2201/2059* (2013.01); *D07B 2201/2065* (2013.01); *D07B 2201/2066* (2013.01); *D07B 2205/2021* (2013.01); *D07B 2205/305* (2013.01); *D07B 2205/3046* (2013.01); *D07B 2205/3071* (2013.01); *D07B 2205/3092* (2013.01); *D07B 2401/206* (2013.01); *D07B 2401/2025* (2013.01)

(56) References Cited

U.S. PATENT DOCUMENTS

| | | | | |
|---|---|---|---|---|
| 4,689,444 | A | 8/1987 | Burgess | |
| 5,475,973 | A * | 12/1995 | Furukawa | D07B 1/0673 57/211 |
| 6,322,907 | B1 * | 11/2001 | Hauser | B32B 15/011 428/375 |
| 6,667,110 | B1 * | 12/2003 | Cordonnier | D07B 1/062 152/451 |
| 7,228,627 | B1 | 6/2007 | Yoshimura et al. | |
| 8,245,490 | B2 * | 8/2012 | Barguet | D07B 1/0633 57/217 |
| 2004/0108038 | A1 | 6/2004 | Cordonnier et al. | |
| 2010/0068495 | A1 | 3/2010 | Rommel et al. | |
| 2012/0175034 | A1 | 7/2012 | Gauthier et al. | |

FOREIGN PATENT DOCUMENTS

| | | |
|---|---|---|
| JP | 2005-336664 | 12/2005 |
| JP | 2007-031890 | 2/2007 |
| WO | 2010/112444 | 10/2010 |
| WO | 2012/095224 | 7/2012 |

OTHER PUBLICATIONS

"Polygonally Preformed Steel Elements"; Research Disclosure; Mason Publications; Hampshire, GB, No. 363, Jul. 1, 1994.

International Search Report which issued in connection with International Application No. PCT/GB2013/000057 dated Oct. 16, 2013.

Great Britain Search and Examination Report which issued in connection with GB1302325.4 dated Aug. 12, 2013.

* cited by examiner

MULTIPLE LAYER WIRE STRAND

This invention relates to wire strands.

Known wire strands comprising 1×7, 1×19 or 1×37 wires are too stiff to be secured around an anchor point. Other types of wire strand can provide the necessary flexibility but lack the required strength.

According to one aspect of this invention, there is provided a wire strand comprising a plurality of wires, the wires comprising a central king wire and at least one layer of wires arranged around the king wire, wherein the composition of at least one of the wires differs from the composition of the other wires.

According to another aspect of this invention, there is provided a wire strand comprising a plurality of wires, the wires comprising: a central king wire formed of steel having a carbon content of at least 0.3 wt %; a first layer of wires arranged around the king wire, each wire of the first layer being formed of steel having a carbon content which is less than the carbon content of the king wire; and a second layer of wires arranged around the first layer, each wire of the second layer being formed of steel having a carbon content which is substantially the same as, or greater than, the carbon content of the wires of the first layer.

In the embodiments described herein, the wires are formed of steel containing carbon, and the carbon content of the steel forming at least one of the wires is different from the carbon content of the steel forming the other wires. In the embodiments described herein, the wires formed of steel having different carbon content is advantageous, because it allows the wire strands so formed to have desired properties.

The wires in each layer may be formed of steel having a carbon content in the range of substantially 0.03 wt % to substantially 0.8 wt %, desirably substantially 0.03 wt % to substantially 0.6 wt %.

At least one of the wires may be formed of steel having a carbon content of substantially 0.3 wt % to substantially 0.8 wt %, desirably in the range of 0.35 wt % to 0.6 wt %, more desirably in the range of 0.4 wt % to 0.6 wt %. At least one of the wires may be formed of steel having a carbon content in the range of substantially 0.03 wt % to substantially 0.3 wt.

At least one of the wires may be formed of steel having a carbon content in the range of substantially 0.15 wt % to substantially 0.3 wt %. At least one of the wires may be formed of steel having a carbon content in the range of substantially 0.03 wt % to substantially 0.15 wt %, desirably substantially 0.05 wt % to substantially 0.15 wt %.

The wires may be formed of steel. In one embodiment, at least, some of the wires in the, or each, layer may be formed of steel having a carbon content that is different from the carbon content of the steel forming at least one wire of the same layer. In another embodiment, the wires in the, or each, layer may be formed of steel having substantially the same carbon content as the carbon content of the steel forming the wires in the same layer.

The wires in the, or each, layer may be formed of steel having different carbon content to the steel from which the wires in the, or each, other layer are formed, or from which the king wire is formed. In the preferred embodiment described herein, there is provided a wire strand formed of multi-carbon steel.

At least one of the wires may comprise a stiffener wire, which is stiffer than at least some, and preferably all, of the other wires in the wire strand. The, or each, other layer may provide support and/or flexibility to the wire strand.

At least one of the wires, for example the king wire, may be formed of steel having a carbon content in the range of substantially 0.3 wt % to substantially 0.6 wt %, desirably in the range of substantially 0.35 wt % to substantially 0.6 wt %, more desirably in the range of substantially 0.4 wt % to substantially 0.6 wt %. In some embodiments, at least one of the wires, for example, the king wire, may have a carbon content in the range of substantially 0.45 wt % to substantially 0.55 wt %. In other embodiments, at least one of the wires, for example, the king wire, may have a carbon content in the range of substantially 0.35 wt % to substantially 0.4 wt %.

The king wire may be formed of steel having a carbon content of substantially 0.4 wt %. The king wire may be formed of steel having a carbon content of substantially 0.43 wt %. The king wire may be formed of steel having a carbon content of substantially 0.38 wt %.

The wire strand may include a first layer, which may comprise a plurality of wires arranged around the king wire. The first layer may comprise six wires.

The first layer may comprise a plurality of wires formed of steel having a carbon content in the range of substantially 0.03 wt % to substantially 0.3 wt %, suitably, substantially 0.05 wt % to substantially 0.3 wt %, desirably substantially 0.05 wt % to substantially 0.2 wt %, more desirably substantially 0.15 wt % to substantially 0.2 wt %. The first layer may comprise a plurality of wires formed of steel having a carbon content in the range of substantially 0.15 wt % to substantially 0.3 wt %, more desirably substantially 0.2 wt % to substantially 0.3 wt %.

The first layer may comprise a plurality of wires formed of steel having a carbon content in the range of substantially 0.16 wt % to substantially 0.2 wt %. The first layer may comprise a plurality of wires formed of steel having a carbon content of substantially 0.18 wt %.

The wire strand may include a second layer, which may comprise a plurality of wires arranged around the first layer. The second layer may comprise 12 wires.

The second layer may comprise a plurality of wires formed of steel having a carbon content in the range of substantially 0.03 wt % to substantially 0.3 wt %, desirably substantially 0.05 wt % to substantially 0.3 wt %, desirably substantially 0.05 wt % to substantially 0.15 wt %.

Suitably, the second layer may comprise a plurality of wires formed of steel having a carbon content in the range of substantially 0.03 wt % to substantially 0.15 wt %, more desirably substantially 0.03 wt % to substantially 0.08 wt %. The second layer may comprise wires having a carbon content in the range of substantially 0.03 wt % to substantially 0.15 wt %, desirably substantially 0.05 wt % to substantially 0.15 wt %. Alternatively, the second layer may comprise wires having a carbon content in the range of substantially 0.15 wt % to substantially 0.3 wt %.

The second layer may comprise wires having a carbon content in the range of substantially 0.03 wt % to substantially 0.08 wt %, The second layer may comprise wires having a carbon content of substantially 0.06 wt %.

The king wire may have a carbon content in the range of substantially 0.35 wt % to substantially 0.4 wt %.

Alternatively, the first layer may comprise a plurality of wires formed of steel having a carbon content in the range of substantially 0.03 wt % to substantially 0.3 wt %, desirably, substantially 0.05 wt % to substantially 0.3 wt %, more desirably, substantially 0.05 wt % to substantially 0.15 wt %.

The first layer may comprise a plurality of wires formed of steel having a carbon content in the range of substantially 0.03 wt % to substantially 0.15 wt %, more desirably substantially 0.03 wt % to substantially 0.08 wt %. The first layer may comprise wires having a carbon content in the range of substantially 0.03 wt % to substantially 0.15 wt %, desirably substantially 0.05 wt % to substantially 0.15 wt %.

The first layer may comprise wires having a carbon content in the range of substantially 0.03 wt % to substantially 0.08 wt %, The first layer may comprise wires having a carbon content of substantially 0.06 wt %.

The second layer may comprise a plurality of wires formed of steel having a carbon content in the range of substantially 0.03 wt % to substantially 0.3 wt %, suitably, substantially 0.05 wt % to substantially 0.3 wt %, desirably substantially 0.05 wt % to substantially 0.2 wt %, more desirably substantially 0.15 wt % to substantially 0.2 wt %. The second layer may comprise a plurality of wires formed of steel having a carbon content in the range of substantially 0.15 wt % to substantially 0.3 wt %, more desirably substantially 0.2 wt % to substantially 0.3 wt %.

The second layer may comprise a plurality of wires formed of steel having a carbon content in the range of substantially 0.16 wt % to substantially 0.2 wt %. The second layer may comprise a plurality of wires formed of steel having a carbon content of substantially 0.18 wt %.

If desired, some of the wires forming the first and/or second layers may be formed of steel having a relatively high carbon and the other wires may be formed of steel having a relatively low carbon content. The wires having the relatively high carbon content may contain carbon in the range in the range of substantially 0.15 wt % to substantially 0.3 wt %, desirably substantially 0.18 wt % to substantially 0.2 wt %. The wires having the relatively low carbon content may contain carbon in the range of substantially 0.03 wt % to substantially 0.08 wt %, desirably substantially 0.06 wt % to 0.08 wt %.

The wires formed of steel having the relatively high carbon content may be arranged in the relevant layer in an alternating relationship with the wires formed of steel having the relatively low carbon content.

Alternatively, the second layer may comprise a plurality of wires formed of steel having a carbon content in the range of substantially 0.4 wt % to substantially 0.8 wt %, desirably substantially 0.45 wt % to substantially 0.75 wt %, more desirably substantially 0.5 wt % to substantially 0.7 wt %. The second layer may comprise a plurality of wires formed of steel having a carbon content in the range of substantially 0.55 wt % to substantially 0.65 wt %.

Alternatively, the king wire may have a carbon content in the range of substantially 0.45 wt % to substantially 0.55 wt %.

In a first embodiment, the first layer may comprise a plurality of wires formed of steel having a carbon content in the range of substantially 0.03 wt % to substantially 0.3 wt %, desirably substantially 0.05 wt % to substantially 0.2 wt %, more desirably substantially 0.15 wt % to substantially 0.2 wt %. The first layer may comprise a plurality of wires formed of steel having a carbon content in the range of substantially 0.15 wt % to substantially 0.3 wt %.

In the first embodiment, the first layer may comprise a plurality of wires formed of steel having a carbon content in the range of substantially 0.16 wt % to substantially 0.2 wt %. The first layer may comprise a plurality of wires formed of steel having a carbon content of substantially 0.18 wt %.

In the first embodiment, the second layer may comprise a plurality of wires formed of steel having a carbon content in the range of substantially 0.03 wt % to substantially 0.3 wt %, desirably substantially 0.03 wt % to substantially 0.15 wt %, more desirably substantially 0.03 wt % to substantially 0.08 wt %. The second layer may comprise wires having a carbon content in the range of substantially 0.03 wt % to substantially 0.15 wt %, desirably substantially 0.05 wt % to substantially 0.15 wt %. Alternatively, the second layer may comprise wires having a carbon content in the range of substantially 0.15 wt % to substantially 0.3 wt %.

In the first embodiment, the second layer may comprise wires having a carbon content in the range of substantially 0.03 wt % to substantially 0.08 wt %. The second layer may comprise wires having a carbon content of substantially 0.06 wt %.

In the first embodiment, the king wire may have a carbon content in the range of substantially 0.35 wt % to substantially 0.4 wt %.

In a second embodiment, the first layer may comprise a plurality of wires formed of steel having a carbon content in the range of substantially 0.03 wt % to substantially 0.3 wt %, desirably substantially 0.03 wt % to substantially 0.15 wt %, more desirably substantially 0.03 wt % to substantially 0.08 wt %. The first layer may comprise wires having a carbon content in the range of substantially 0.03 wt % to substantially 0.15 wt %, desirably substantially 0.05 wt % to substantially 0.15 wt %.

In the second embodiment, the first layer may comprise wires having a carbon content in the range of substantially 0.03 wt % to substantially 0.08 wt %. The first layer may comprise wires having a carbon content of substantially 0.06 wt %.

In the second embodiment, the second layer may comprise a plurality of wires formed of steel having a carbon content in the range of substantially 0.03 wt % to substantially 0.3 wt %, desirably substantially 0.05 wt % to substantially 0.2 wt %, more desirably substantially 0.15 wt % to substantially 0.2 wt %. The second layer may comprise a plurality of wires formed of steel having a carbon content in the range of substantially 0.15 wt % to substantially 0.3 wt %.

In the second embodiment, the second layer may comprise a plurality of wires formed of steel having a carbon content in the range of substantially 0.16 wt % to substantially 0.2 wt %. The second layer may comprise a plurality of wires formed of steel having a carbon content of substantially 0.18 wt %.

In the second embodiment, the king wire may have a carbon content in the range of substantially 0.35 wt % to substantially 0.4 wt %.

In a third embodiment, the first layer may comprise a plurality of wires formed of steel having a carbon content in the range of substantially 0.03 wt % to substantially 0.3 wt %, desirably substantially 0.05 wt % to substantially 0.2 wt %, more desirably substantially 0.15 wt % to substantially 0.2 wt %. The first layer may comprise a plurality of wires formed of steel having a carbon content in the range of substantially 0.15 wt % to substantially 0.3 wt %.

In the third embodiment, the first layer may comprise a plurality of wires formed of steel having a carbon content in the range of substantially 0.16 wt % to substantially 0.2 wt %. The first layer may comprise a plurality of wires formed of steel having a carbon content of substantially 0.18 wt %.

In the third embodiment, the second layer may comprise a plurality of wires formed of steel having a carbon content in the range of substantially 0.03 wt % to substantially 0.3 wt %, desirably substantially 0.05 wt % to substantially 0.2 wt %, more desirably substantially 0.15 wt % to substantially 0.2 wt %. The second layer may comprise a plurality of wires formed of steel having a carbon content in the range of substantially 0.15 wt % to substantially 0.3 wt %.

In the third embodiment, the second layer may comprise a plurality of wires formed of steel having a carbon content in the range of substantially 0.16 wt % to substantially 0.2 wt %. The second layer may comprise a plurality of wires formed of steel having a carbon content of substantially 0.18 wt %.

In the third embodiment, the king wire may have a carbon content in the range of substantially 0.35 wt % to substantially 0.4 wt %.

In a fourth embodiment, the first layer may comprise a plurality of wires formed of steel having a carbon content in the range of substantially 0.03 wt % to substantially 0.3 wt %, desirably substantially 0.05 wt % to substantially 0.2 wt %, more desirably substantially 0.15 wt % to substantially 0.2 wt %. The first layer may comprise a plurality of wires formed of steel having a carbon content in the range of substantially 0.15 wt % to substantially 0.3 wt %.

In the fourth embodiment, the first layer may comprise a plurality of wires formed of steel having a carbon content in the range of substantially 0.16 wt % to substantially 0.2 wt %. The first layer may comprise a plurality of wires formed of steel having a carbon content of substantially 0.18 wt %.

In the fourth embodiment, the second layer may comprise a plurality of wires formed of steel having a carbon content in the range of substantially 0.4 wt % to substantially 0.8 wt %, desirably substantially 0.45 wt % to substantially 0.75 wt %, more desirably substantially 0.5 wt % to substantially 0.7 wt %. The second layer may comprise a plurality of wires formed of steel having a carbon content in the range of substantially 0.55 wt % to substantially 0.65 wt %.

In the fourth embodiment, the king wire may have a carbon content in the range of substantially 0.45 wt % to substantially 0.55 wt %.

The wire strand may be a 1×7 wire strand, a 1×19 wire strand or a 1×37 wire strand.

According to another aspect of this invention, there is provided a wire strand comprising a central king wire and plurality of wires arranged in a plurality of layers around the king wire, the central king wire being formed of steel having a carbon content in the range of substantially 0.3 wt % to substantially 0.6 wt %, a first layer around the king wire, and a second layer around the first layer, the first layer comprising a plurality of wires formed of steel having a carbon content in the range of substantially 0.03 wt % to substantially 0.3 wt %, and the second layer comprising a plurality of wires formed of steel having a carbon content in the range of substantially 0.03 wt % to substantially 0.3 wt %.

In the first and second embodiments, the carbon content of the steel forming the wires in the first layer may be the same for all the wires in the first layer.

Alternatively, the carbon content of the steel forming at least one of the wires in the first layer may be different from the carbon content of the steel forming the other wires in the first layer. If desired, in the first and second embodiments, the carbon content of the steel forming some of the wires in the first layer may be different from the carbon content of the steel forming the other wires in the first layer. The wires in the first layer may be arranged such that the wires having the different carbon contents alternate relative to each other.

The carbon content of the steel forming the wires in the second layer may be the same for all the wires in the second layer.

Alternatively, the carbon content of the steel forming at least one of the wires in the second layer may be different from the carbon content of the steel forming the other wires in the second layer.

If desired, the carbon content of the steel forming some of the wires in the second layer may be different from the carbon content of the steel forming the other wires in the second layer. The wires in the second layer may be arranged such that the wires having the different carbon contents alternate relative to each other.

In one embodiment, the first and second layers may comprise wires formed of steel having a carbon content in the range of substantially 0.05 wt % to substantially 0.3 wt %.

In another embodiment, the first layer may comprise wires formed of steel having a carbon content in the range of substantially 0.15 wt % to 0.3 wt %, desirably substantially 0.16 wt % to substantially 0.2 wt %, more desirably substantially 0.18 wt %, and the second layer may comprise wires formed of steel having a carbon content in the range of substantially 0.03 wt % to 0.15 wt %, desirably substantially 0.03 wt % to substantially 0.08 wt %, more desirably substantially 0.06 wt %.

The first layer may be substantially concentric relative to the king wire. The first layer may constitute an intermediate layer. The wires in the first layer may be formed of a material to provide support and/or flexibility to the wire strand.

The second layer may be substantially concentric relative to the first layer. The second layer may constitute an outer layer. The wires in the second layer may be formed of a material to provide support and/or flexibility to the wire strand.

If desired, in third and fourth embodiments, the wire strand may comprise a third layer, which may comprise third wires formed of steel having a carbon content in the range of substantially 0.03 wt % to substantially 0.3 wt %. The third layer may comprise eighteen third wires.

The third layer may comprise wires formed of steel having a carbon content in the range of substantially 0.03 wt % to substantially 0.15 wt %. Alternatively, the third layer may comprise third wires formed of steel having a carbon content in the range of substantially 0.15 wt % to substantially 0.3 wt %.

The carbon content of the steel forming the wires in the third layer may be the same for all the wires in the third layer. Alternatively, the carbon content of the steel forming at least one of the wires in the third layer may be different from the carbon content of the steel forming the other wires in the third layer.

In one embodiment, all the wires may be formed of carbon steel. In this embodiment, the king wire may be formed of high carbon steel, the wires in the first layer may be formed of medium carbon steel or low carbon steel, and the wires in the second layer may be formed of medium carbon steel or low carbon steel.

The steel from which each wire is formed may contain other elements, such as one or more of manganese, phosphorus, sulphur, silicon, chromium, molybdenum, nickel, copper. The amounts of each of the aforesaid other elements may be selected as appropriate by the skilled person.

The king wire may have a diameter in the range of substantially 0.2 mm to substantially 2.03 mm, desirably in the range of substantially 0.2 mm to 2 mm. The tensile strength of the king wire may be between substantially 1,650 $N/mm^2$ and substantially 1,950 $N/mm^2$.

In at least one embodiment, each of the wires in the first layer may have a diameter in the range of substantially 0.2 mm to substantially 2 mm. The tensile strength of each of the wires in the first layer may be between substantially 1300 $N/mm^2$ and substantially 1600 $N/mm^2$.

In at least one embodiment, each of the wires in the second layer may have a diameter in the range of substantially 0.2 mm to substantially 2 mm. The tensile strength of the steel from which the each of the wires in the second layer is formed may be between substantially 950 $N/mm^2$ and substantially 1,250 $N/mm^2$.

In at least one embodiment, each of the wires in the first layer may have a diameter in the range of substantially 0.2 mm to substantially 2 mm. The tensile strength of the steel from which the each of the wires in the first layer is formed may be between substantially 950 $N/mm^2$ and substantially 1,250 $N/mm^2$.

In at least one embodiment, each of the wires in the second layer may have a diameter in the range of substantially 0.2 mm to substantially 2 mm. The tensile strength of each of the wires in the second layer may be between substantially 1300 $N/mm^2$ and substantially 1600 $N/mm^2$.

In at least one embodiment, each of the wires in the first and second layers may have a diameter in the range of substantially 0.2 mm to substantially 2 mm. The tensile strength of each of the wires in the first and second layers may be between substantially 1300 $N/mm^2$ and substantially 1600 $N/mm^2$.

In at least one embodiment, each of the wires in the third layer may have a diameter in the range of substantially 0.2 mm to substantially 2 mm. The tensile strength of the steel from which the each of the wires in the third layer is formed may be between substantially 950 $N/mm^2$ and substantially 1,250 $N/mm^2$.

In at least one embodiment, where the wire strand comprises a third layer, each of the wires in the first and second layers may have a diameter in the range of substantially 0.2 mm to substantially 2 mm. The tensile strength of the steel from which the each of the wires in the first and second layers are formed may be between substantially 950 $N/mm^2$ and substantially 1,250 $N/mm^2$.

In at least one embodiment, each of the wires in the third layer may have a diameter in the range of substantially 0.2 mm to substantially 2 mm. The tensile strength of each of the wires in the third layer may be between substantially 1,300 $N/mm^2$ and substantially 1,600 $N/mm^2$.

One, some, or each of the wires in the wire strand may be coated, for example by galvanising with zinc, which may be in an amount of substantially 15 $g/m^2$. In at least one embodiment, one, some or each of the wires may be coated, for example by galvanising, with a zinc aluminium coating.

One, some, or each of the wires may be coated with a plastics material. In one embodiment, one of the wires of the second layer may be coated with the plastics material. This provides an advantage in one of the embodiments described herein of providing an indicator to allow users to identify the origin of the wire strand.

In another embodiment, each of the wire strands in the second layer may be coated with a plastics material. This provides an advantage in the embodiment described herein of protecting the wire strand from corrosion.

In a further embodiment, each of the wires in the wire strand may be coated with a plastics material. This provides the advantage in the embodiment described herein of protecting all of the wires individually from corrosion.

The plastics material may comprise polyvinylchloride (PVC), polypropylene or nylon.

Embodiments of the invention will now be described by way of example only, with reference to the accompanying drawings, in which.

Figure 1:
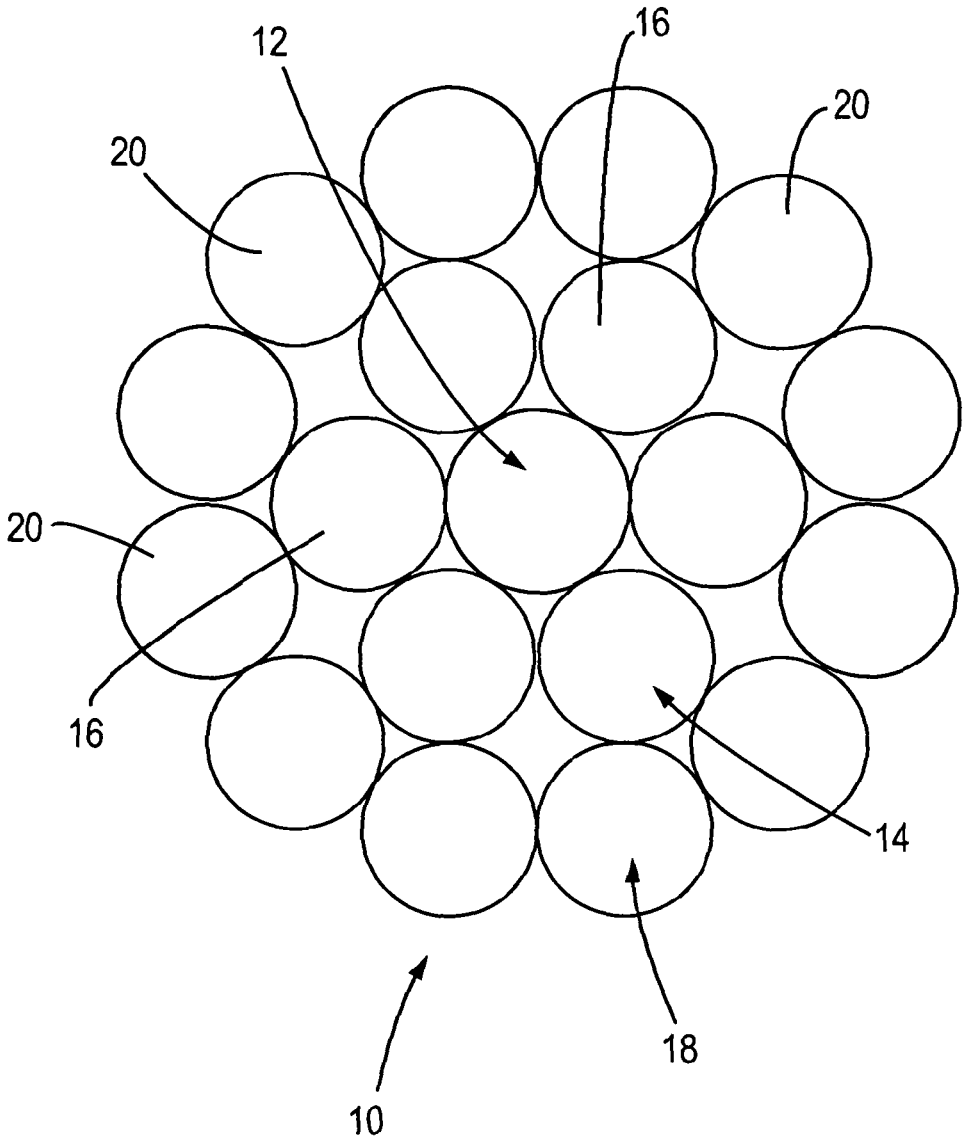
FIG. 1 shows an end view of a 1×19 wire strand.

FIG. 1 shows an end view of a 1×19 wire strand 10, which comprises a central core wire in the form of a king wire 12, a first, or intermediate, layer 14 comprising a plurality of wires 16, and a second, or outer, layer 18 comprising a plurality of wires 20.

The first layer 14 is arranged concentrically around the king wire 12, and comprises six wires 16. The second layer 18 is arranged concentrically around the first layer 14, and comprises twelve wires 20.

A wire strand shown in the drawing can be made by known techniques, to wrap the wires 16 around the king wire 12 to form the first layer 14, and thereafter to wrap the wires 20 around the first layer 14 to form the second layer 18.

In a first embodiment, the king wire 12 constitutes a stiffener wire for stiffening the wire strand 10. In a first embodiment, the king wire 12 is formed of high carbon steel, having a carbon content in the range of 0.3 wt % to 0.6 wt %.

The provision of the king wire 12 being formed of a high carbon steel provides an advantage in the first embodiment, that it enables the wire strand 10 to lie in a position that is substantially straight when not under tension. The wires 16 of the first layer 14 provide support and flexibility to the wire strand 10, and can be formed of medium carbon steel, having a carbon content in the range of 0.15 wt % to 0.3 wt or low carbon steel, having a carbon content in the range of 0.03 wt % to 0.15 wt %.

The wires 20 of the second layer 18 also provide support and flexibility to the wire strand 10. The wires 20 can be formed of medium carbon steel having a carbon content in the range of 0.15 wt % to 0.3 wt %, or low carbon steel, having a carbon content in the range of 0.03 wt % to 0.15 wt %.

In at least one embodiment, the wires 16, 20 of the first and second layers 14, 18 provide the advantage that they impart sufficient flexibility to the wire strand 10 that allows the wire strand 10 to be deformed into a loop around an anchor point to allow an end region of the wire strand 10 to be secured to the anchor point.

Tables 1A and 1B set out a range of diameters, compositions and properties of the king wire 12 and the wires 16, 20 of the first and second layers 14, 18 for some examples of wire strands manufactured according to embodiments of the present invention.

TABLE 1A

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.4 to 0.43 (+/−0.01) | 0.35 to 0.4 | 0.5 to 0.8 | up to 0.03 | up to 0.03 | up to 0.25 | 1650 to 1950 |
| First layer | 0.4 (+/−0.01) | 0.16 to 0.2 | 0.6 to 0.9 | up to 0.03 | up to 0.03 | up to 0.25 | 1300 to 1600 |
| Second layer | 0.4 (+/−0.01) | 0.03 to 0.08. | 0.2 to 0.5 | up to 0.03 | up to 0.03 | up to 0.1 | 950 to 1250 |

TABLE 1B

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.6 to 0.64 (+/−0.01) | 0.35 to 0.4 | 0.5 to 0.8 | up to 0.03 | up to 0.03 | up to 0.25 | 1650 to 1950 |
| First layer | 0.6 (+/−0.01) | 0.16 to 0.2 | 0.6 to 0.9 | up to 0.03 | up to 0.03 | up to 0.25 | 1300 to 1600 |
| Second layer | 0.6 (+/−0.01) | 0.03 to 0.08. | 0.2 to 0.5 | up to 0.03 | up to 0.03 | up to 0.1 | 950 to 1250 |

Tables 2A, 2B. 2.1A and 2.1B set out a range of diameters, compositions and properties of the king wire 12 and the wires 16, 20 of the first and second layers 14, 18 for some examples of wire strands manufactured according to further embodiments of the present invention.

TABLE 2A

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.4 to 0.43 (+/−0.01) | 0.35 to 0.4 | 0.5 to 0.8 | up to 0.03 | up to 0.03 | up to 0.25 | 1650 to 1950 |
| First layer | 0.4 (+/−0.01) | 0.03 to 0.08 | 0.2 to 0.5 | up to 0.03 | up to 0.03 | up to 0.1 | 950 to 1250 |
| Second layer | 0.4 (+/−0.01) | 0.16 to 0.2 | 0.6 to 0.9 | up to 0.03 | up to 0.03 | up to 0.25 | 1300 to 1600 |

TABLE 2B

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.6 to 0.64 (+/−0.01) | 0.35 to 0.4 | 0.5 to 0.8 | up to 0.03 | up to 0.03 | up to 0.25 | 1650 to 1950 |
| First layer | 0.6 (+/−0.01) | 0.03 to 0.08 | 0.2 to 0.5 | up to 0.03 | up to 0.03 | up to 0.1 | 950 to 1250 |
| Second layer | 0.6 (+/−0.01) | 0.16 to 0.2 | 0.6 to 0.9 | up to 0.03 | up to 0.03 | up to 0.25 | 1300 to 1600 |

TABLE 2.1A

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.4 to 0.43 (+/−0.01) | 0.35 to 0.4 | 0.5 to 0.8 | up to 0.03 | up to 0.03 | up to 0.25 | 1650 to 1950 |
| First layer | 0.4 (+/−0.01) | 0.16 to 0.2 | 0.6 to 0.9 | up to 0.03 | up to 0.03 | up to 0.25 | 1300 to 1600 |
| Second layer | 0.4 (+/−0.01) | 0.16 to 0.2 | 0.6 to 0.9 | up to 0.03 | up to 0.03 | up to 0.25 | 1300 to 1600 |

TABLE 2.1B

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.6 to 0.64 (+/−0.01) | 0.35 to 0.4 | 0.5 to 0.8 | up to 0.03 | up to 0.03 | up to 0.25 | 1650 to 1950 |
| First layer | 0.6 (+/−0.01) | 0.16 to 0.2 | 0.6 to 0.9 | up to 0.03 | up to 0.03 | up to 0.25 | 1300 to 1600 |
| Second layer | 0.6 (+/−0.01) | 0.16 to 0.2 | 0.6 to 0.9 | up to 0.03 | up to 0.03 | up to 0.25 | 1300 to 1600 |

TABLE 2.2A

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.4 to 0.43 (+/−0.01) | 0.45 to 0.55 | 0.5 to 0.8 | up to 0.03 | up to 0.03 | up to 0.25 | 1650 to 1950 |
| First layer | 0.4 (+/−0.01) | 0.16 to 0.2 | 0.6 to 0.9 | up to 0.03 | up to 0.03 | up to 0.25 | 1300 to 1600 |
| Second layer | 0.4 (+/−0.01) | 0.55 to 0.65 | 0.5 to 0.8 | up to 0.03 | up to 0.03 | up to 0.25 | 1650 to 1950 |

TABLE 2.2B

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.6 to 0.64 (+/−0.01) | 0.45 to 0.55 | 0.5 to 0.8 | up to 0.03 | up to 0.03 | up to 0.25 | 1650 to 1950 |
| First layer | 0.6 (+/−0.01) | 0.16 to 0.2 | 0.6 to 0.9 | up to 0.03 | up to 0.03 | up to 0.25 | 1300 to 1600 |
| Second layer | 0.6 (+/−0.01) | 0.55 to 0.65 | 0.5 to 0.8 | up to 0.03 | up to 0.03 | up to 0.25 | 1650 to 1950 |

Each wire described in Tables 1A, 1B 2A, 2B, 2.1A, 2.1B, 2.2A and 2.2B can be galvanised with a zinc coating. Alternatively, each wire described in Tables 1A, 1B 2A, 2B, 2.1A, 2.1B, 2.2A and 2.2B can be galvanised with a zinc aluminium coating. The zinc coating and the zinc aluminium coating is provided in an amount of substantially 15 $g/m^2$.

Tables 3A and 3B show specific examples of a wire strand made according to a first embodiment of the invention, for example as shown in Tables 1A and 1B.

TABLE 3A

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.42 (+/−0.01) | 0.38 | 0.7 | 0.02 | 0.02 | 0.15 |
| First layer | 0.4 (+/−0.01) | 0.18 | 0.8 | 0.02 | 0.02 | 0.15 |
| Second layer | 0.4 (+/−0.01) | 0.06 | 0.4 | 0.02 | 0.02 | 0.05 |

TABLE 3B

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.64 (+/−0.01) | 0.38 | 0.7 | 0.02 | 0.02 | 0.15 |
| First layer | 0.6 (+/−0.01) | 0.18 | 0.8 | 0.02 | 0.02 | 0.15 |
| Second layer | 0.6 (+/−0.01) | 0.06 | 0.4 | 0.02 | 0.02 | 0.05 |

Tables 4A and 4B show specific examples of wire strands made according to a second embodiment of the invention, for example as shown in Tables 2A and 2B.

TABLE 4A

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.42 (+/−0.01) | 0.38 | 0.7 | 0.02 | 0.02 | 0.15 |
| First layer | 0.4 (+/−0.01) | 0.06 | 0.4 | 0.02 | 0.02 | 0.05 |
| Second layer | 0.4 (+/−0.01) | 0.18 | 0.8 | 0.02 | 0.02 | 0.15 |

TABLE 4B

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.64 (+/−0.01) | 0.38 | 0.7 | 0.02 | 0.02 | 0.15 |
| First layer | 0.6 (+/−0.01) | 0.06 | 0.4 | 0.02 | 0.02 | 0.05 |
| Second layer | 0.6 (+/−0.01) | 0.18 | 0.8 | 0.02 | 0.02 | 0.15 |

Tables 4.1A and 4.1B show specific examples of wire strands made according to a third embodiment of the invention, for example as shown in Tables 2.1A and 2.1B.

TABLE 4.1A

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.42 (+/−0.01) | 0.38 | 0.7 | 0.02 | 0.02 | 0.15 |
| First layer | 0.4 (+/−0.01) | 0.18 | 0.8 | 0.02 | 0.02 | 0.15 |
| Second layer | 0.4 (+/−0.01) | 0.18 | 0.8 | 0.02 | 0.02 | 0.15 |

TABLE 4.1B

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.64 (+/−0.01) | 0.38 | 0.7 | 0.02 | 0.02 | 0.15 |
| First layer | 0.6 (+/−0.01) | 0.18 | 0.8 | 0.02 | 0.02 | 0.15 |
| Second layer | 0.6 (+/−0.01) | 0.18 | 0.8 | 0.02 | 0.02 | 0.15 |

Tables 4.2A and 4.2B show specific examples of wire strands made according to a third embodiment of the invention, for example as shown in Tables 2.2A and 2.2B.

TABLE 4.2A

| Wires | Diameter (mm) | Carbon (wt %) | Manganese (wt %) | Phosphorus (wt %) | Sulphur (wt %) | Silicon (wt %) |
|---|---|---|---|---|---|---|
| King Wire | 0.42 (+/−0.01) | 0.5 | 0.7 | 0.02 | 0.02 | 0.15 |
| First layer | 0.4 (+/−0.01) | 0.18 | 0.8 | 0.02 | 0.02 | 0.15 |
| Second layer | 0.4 (+/−0.01) | 0.6 | 0.7 | 0.02 | 0.02 | 0.15 |

TABLE 4.2B

| Wires | Diameter (mm) | Carbon (wt %) | Manganese (wt %) | Phosphorus (wt %) | Sulphur (wt %) | Silicon (wt %) |
|---|---|---|---|---|---|---|
| King Wire | 0.64 (+/−0.01) | 0.5 | 0.7 | 0.02 | 0.02 | 0.15 |
| First layer | 0.6 (+/−0.01) | 0.18 | 0.8 | 0.02 | 0.02 | 0.15 |
| Second layer | 0.6 (+/−0.01) | 0.6 | 0.7 | 0.02 | 0.02 | 0.15 |

The embodiments of the wire strand 10 described herein are particularly suitable for use in suspending articles from overhead supports, for example as described in GB2322435A.

Tables 5 and 6 show the use of wires of different diameters in the formation of wire strands 10 having diameters in the range of substantially 1 mm to substantially 10.03 mm.

TABLE 5

| | Wire diameter (mm) | | | | | | | | |
|---|---|---|---|---|---|---|---|---|---|
| King wire | 0.2 | 0.4 | 0.6 | 0.8 | 0.95 | 1 | 1.2 | 1.6 | 2 |
| First layer | 0.2 | 0.4 | 0.6 | 0.8 | 0.95 | 1 | 1.2 | 1.6 | 2 |
| Second layer | 0.2 | 0.4 | 0.6 | 0.8 | 0.95 | 1 | 1.2 | 1.6 | 2 |
| Total Diameter of wire strand (mm) | 1 | 2 | 3 | 4 | 4.75 | 5 | 6 | 8 | 10 |

TABLE 6

| | Wire diameter (mm) | | | | | | | | |
|---|---|---|---|---|---|---|---|---|---|
| King wire | 0.23 | 0.42 | 0.64 | 0.83 | 0.98 | 1.03 | 1.23 | 1.63 | 2.03 |
| First layer | 0.2 | 0.4 | 0.6 | 0.8 | 0.95 | 1 | 1.2 | 1.6 | 2 |
| Second layer | 0.2 | 0.4 | 0.6 | 0.8 | 0.95 | 1 | 1.2 | 1.6 | 2 |
| Total Diameter of wire strand (mm) | 1.03 | 2.02 | 3.04 | 4.03 | 4.78 | 5.03 | 6.03 | 8.03 | 10.03 |

Figure 2:
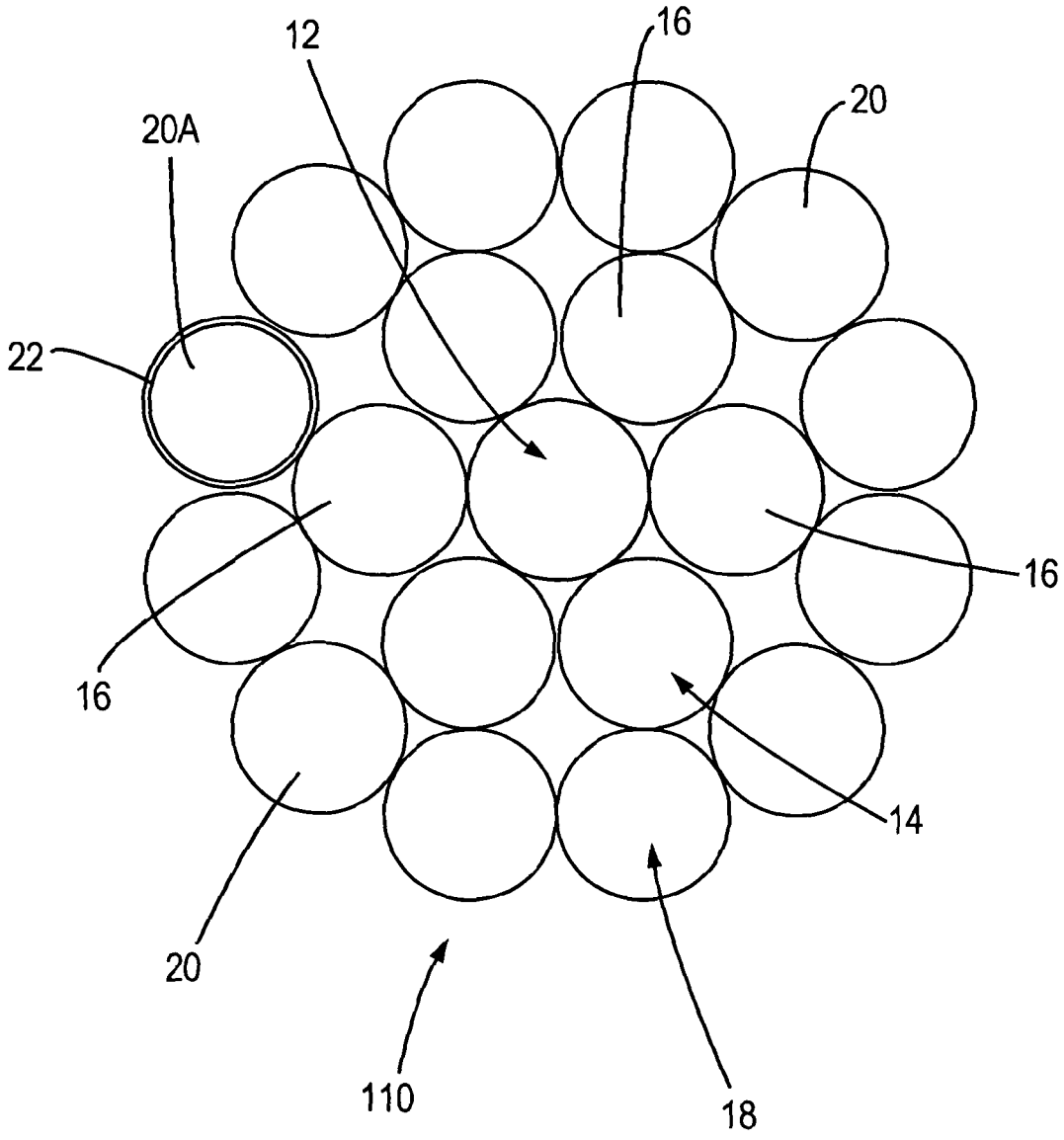
FIG. 2 shows an end view of a further embodiment of a 1×19 wire strand.

FIG. 2 shows a further embodiment of the wire strand, generally designated 110, which comprises some of the features of the embodiment shown in FIG. 1, and these features have been labelled with the same reference numerals as in FIG. 1. The compositions and diameters of the wires shown in FIG. 2 can be the same as described above in Tables 3 or 4.

The wire strand 110 shown in FIG. 2 differs from the embodiment shown in FIG. 1 in that the outer layer 18 comprises twelve wires 20, one of which (designated 20A) is provided with a coating 22 of a plastics material, such as PVC, polypropylene or nylon. The coating 22 can be of any suitable colour, such as red.

The provision of the coating 22 on the wire 20A in the embodiment shown in FIG. 2 provides the advantage that the origin of the wire strand 110 can be easily identified.

Figure 3:
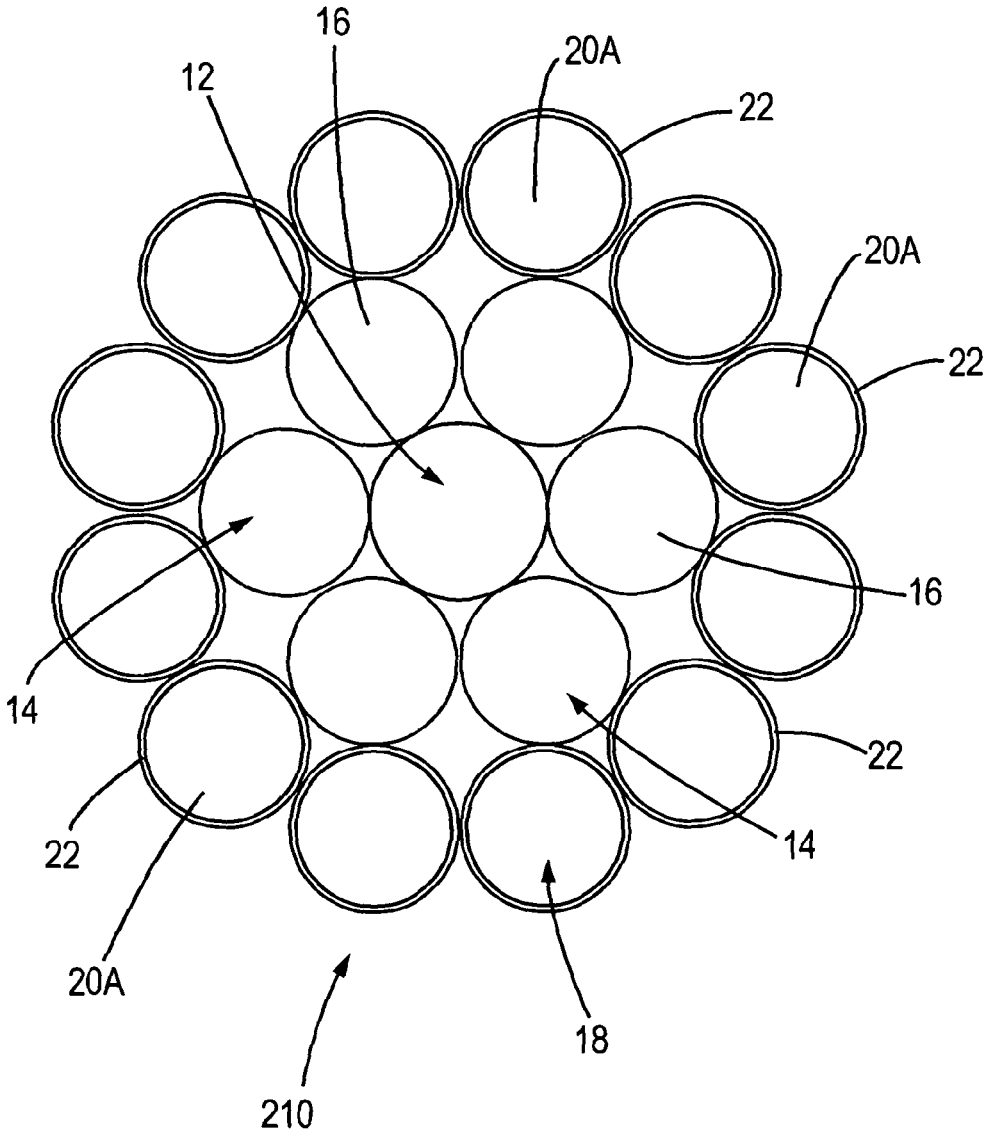
FIG. 3 shows an end view of another embodiment of a 1×19 wire strand.

FIG. 3 shows another embodiment of the wire strand, generally designated 210, which has some of the features of the embodiment shown in FIG. 1, and, again, these have been designated, with the same reference numerals as in FIG. 1. The compositions and diameters of the wires shown in FIG. 3 are the same as described above in Table 3.

The wire strand 210 differs from the wire strand 10 shown in FIG. 1 in that the outer layer 18 comprises a plurality of wire strands 20A, each of which is coated with a coating 22 of a plastics material, such as PVC, polypropylene or nylon.

The provision of the coating 22 on the wires 20A forming the second layer 18 of the embodiment shown in FIG. 3 provides the advantage that all of the wires 12, 16 and 20A are protected from corrosion. The wires 20A of the outer layer 18 provide a water resistant seal to prevent water reaching the first layer 14 and the king wire 12.

Figure 4:
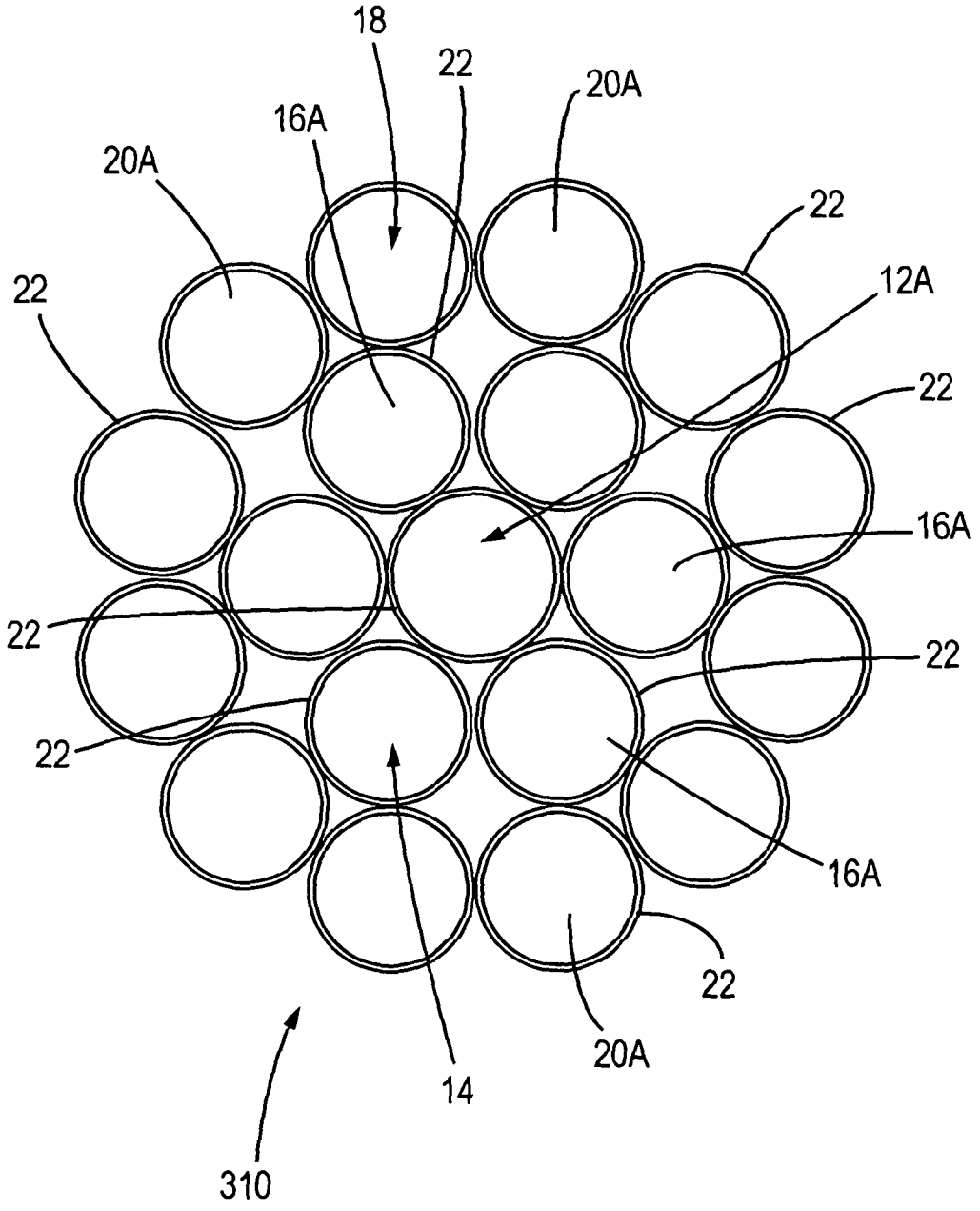
FIG. 4 shows an end view of yet another embodiment of a 1×19 wire strand.

A still further embodiment of the wire strand, generally designated 310, is shown in FIG. 4, which has some of the features of the embodiment shown in FIG. 1, and these have been designated with the same reference numerals as in FIG. 1. The compositions and diameters of the wires shown in FIG. 4 are the same as described above in Table 3

In the embodiment shown in FIG. 4, the inner layer comprises a king wire 12A which is coated with a coating 22 of a plastics material, such as PVC, polypropylene or nylon. The first layer 14 comprises six wires 16A, each of which is coated with a coating 22 of a plastics material, such as PVC, polypropylene or nylon.

The second layer 18 comprises twelve wires 20A, each of which is coated with a coating 22 of a plastics material, such as PVC, polypropylene or nylon.

The coating 22 on all of the wires 12A, 16A, 20A provide the advantage in the embodiment shown in FIG. 4 that each of the wires 12A, 16A, 20A is protected individually from corrosion.

There are thus described wire strands 10, 110, 210 and 310 which are made from a plurality of carbon steel wires arranged in three concentric layers. The wires in each individual layer are formed from the same grade of carbon steel as each other, and wires in different layers are formed from different grades of carbon steel.

At least one of the embodiments described above has the advantage that the different carbon content of the wires provides different stiffness, i.e. the king wire 12 being formed of high carbon steel has a greater stiffness than the wires 16, 20, which are formed of medium carbon steel or low carbon steel.

The greater stiffness of the king wire 12 has the effect that the wire has a tendency to lie straight, and the more flexible wires 16, 20 allow the wire strand to be looped around an anchor point to allow it to be secured to the anchor point.

Various modifications can be made without departing from the scope of the invention. For example, in third and fourth embodiments, the wire strand 10 may comprise a 1×37 wire strand, i.e. the king wire 12, a first layer 14 comprising six wires 16 arranged around the king wire 12, a second layer 18 comprising twelve wires 20 arranged around the first layer 14, and a third layer comprising eighteen wires arrange around the second layer 18.

Table 7A below corresponds to Table 1A above but modified to incorporate a third layer.

TABLE 7A

| Wires | Diameter (mm) | Carbon (wt %) | Manganese (wt %) | Phosphorus (wt %) | Sulphur (wt %) | Silicon (wt %) | Tensile strength ($N/mm^2$) |
|---|---|---|---|---|---|---|---|
| King Wire | 0.4 to 0.43 (+/−0.01) | 0.35 to 0.4 | 0.5 to 0.8 | up to 0.03 | up to 0.03 | up to 0.25 | 1650 to 1950 |
| First layer | 0.4 (+/−0.01) | 0.16 to 0.2 | 0.6 to 0.9 | up to 0.03 | up to 0.03 | up to 0.25 | 1300 to 1600 |
| Second layer | 0.4 (+/−0.01) | 0.03 to 0.08. | 0.2 to 0.5 | up to 0.03 | up to 0.03 | up to 0.1 | 950 to 1250 |
| Third layer if present | 0.4 (+/−0.01 | 0.03 to 0.08 | 0.2 to 0.5 | up to 0.03 | up to 0.03 | up to 0.1 | 950 to 1250 |

Table 7A describes a range of 1×37 wire strands, in which all the wires, namely the king wire, and the wires of the first, second and third layers have a diameter of 0.4 mm.

Table 8A below corresponds to Table 2.1A above, but modified to incorporate a third layer.

TABLE 8A

| Wires | Diameter (mm) | Carbon (wt %) | Manganese (wt %) | Phosphorus (wt. %) | Sulphur (wt %) | Silicon (wt %) | Tensile strength ($N/mm^2$) |
|---|---|---|---|---|---|---|---|
| King Wire | 0.4 to 0.43 (+/−0.01) | 0.35 to 0.4 | 0.5 to 0.8 | up to 0.03 | up to 0.03 | up to 0.25 | 1650 to 1950 |
| First layer | 0.4 (+/−0.01) | 0.03 to 0.08 | 0.6 to 0.9 | up to 0.03 | up to 0.03 | up to 0.1 | 950 to 1250 |
| Second layer | 0.4 (+/−0.01) | 0.03 to 0.08. | 0.2 to 0.5 | up to 0.03 | up to 0.03 | up to 0.1 | 950 to 1250 |
| Third layer | 0.4 (+/−0.01 | 0.16 to 0.2 | 0.2 to 0.5 | up to 0.03 | up to 0.03 | up to 0.25 | 1300 to 1600 |

Table 8A describes a range of 1×37 wire strands, in which the king wire has a diameter of 0.43 mm, and each of the wires of the first, second and third layers have a diameter of 0.4 mm.

Table 9A corresponds to Table 3.1A, but modified to incorporate the third layer.

TABLE 9A

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.42 (+/−0.01) | 0.37 | 0.7 | 0.02 | 0.02 | 0.15 |
| First layer | 0.4 (+/−0.01) | 0.18 | 0.8 | 0.02 | 0.02 | 0.15 |
| Second layer | 0.4 (+/−0.01) | 0.06 | 0.4 | 0.02 | 0.02 | 0.05 |
| Third layer | 0.4 (+/−0.01) | 0.06 | 0.4 | 0.02 | 0.02 | 0.05 |

Table 9A describes a specific 1×37 wire strand, in which the king wire has a diameter of 0.43 mm, and each of the wires of the first, second and third layers have a diameter of 0.4 mm.

Table 10A corresponds to Table 4.1A, but modified to incorporate the third layer.

TABLE 10A

| Wires | Diameter (mm) | Carbon (wt %) | Manganese (wt %) | Phosphorus (wt. %) | Sulphur (wt %) | Silicon (wt %) |
|---|---|---|---|---|---|---|
| King Wire | 0.42 (+/−0.01) | 0.37 | 0.7 | 0.02 | 0.02 | 0.15 |
| First layer | 0.4 (+/−0.01) | 0.06 | 0.4 | 0.02 | 0.02 | 0.05 |

TABLE 10A-continued

| Wires | Diameter (mm) | Carbon (wt %) | Manganese (wt %) | Phosphorus (wt. %) | Sulphur (wt %) | Silicon (wt %) |
|---|---|---|---|---|---|---|
| Second layer | 0.4 (+/−0.01) | 0.06 | 0.4 | 0.02 | 0.02 | 0.05 |
| Third layer | 0.4 (+/−0.01) | 0.18 | 0.8 | 0.02 | 0.02 | 0.15 |

Tables 11 and 12 below correspond to Tables 5 and 6 above, but modified to incorporate a third layer.

TABLE 11

| | Wire diameter (mm) | | | | | | | | |
|---|---|---|---|---|---|---|---|---|---|
| King wire | 0.2 | 0.4 | 0.6 | 0.8 | 0.95 | 1 | 1.2 | 1.6 | 2 |
| First layer | 0.2 | 0.4 | 0.6 | 0.8 | 0.95 | 1 | 1.2 | 1.6 | 2 |
| Second layer | 0.2 | 0.4 | 0.6 | 0.8 | 0.95 | 1 | 1.2 | 1.6 | 2 |
| Third layer | 0.2 | 0.4 | 0.6 | 0.8 | 0.95 | 1 | 1.2 | 1.6 | 2 |
| Total Diameter of wire strand (mm) | 1.4 | 2.8 | 4.2 | 5.6 | 6.65 | 7 | 8.4 | 11.2 | 14 |

TABLE 12

| | Wire diameter (mm) | | | | | | | | |
|---|---|---|---|---|---|---|---|---|---|
| King wire | 0.23 | 0.42 | 0.64 | 0.83 | 0.98 | 1.03 | 1.23 | 1.63 | 2.03 |
| First layer | 0.2 | 0.4 | 0.6 | 0.8 | 0.95 | 1 | 1.2 | 1.6 | 2 |
| Second layer | 0.2 | 0.4 | 0.6 | 0.8 | 0.95 | 1 | 1.2 | 1.6 | 2 |
| Third layer | 0.2 | 0.4 | 0.6 | 0.8 | 0.95 | 1 | 1.2 | 1.6 | 2 |
| Total Diameter of wire strand (mm) | 1.43 | 2.82 | 4.24 | 5.63 | 6.68 | 7.03 | 8.43 | 11.23 | 14.03 |

Tables 11 and 12 show the diameters of 1×37 wire strands using wires of different diameters.

In a further modification, an alternative to the wire strand described in Tables 1 and 3 can be formed. In this modification, the second layer 18 may comprise six of the wires 20, having a relatively high carbon content in the range of 0.16 wt % to 0.2 wt %, for example 0.18 wt %. The second layer 18 may also include six of the wires 20 having a relatively low carbon content in the range of 0.03 wt % to 0.08 wt %, for example 0.06 wt %. The wires 20 having the relatively high carbon content are arranged around the first layer 14 alternately with respect to the wires 20 having the relatively low carbon content.

The invention claimed is:

1. A wire strand comprising a plurality of wires, the wires comprising: a central king wire formed of steel having a carbon content in the range of 0.3 wt % to 0.6 wt %; a first layer of wires arranged around the king wire, the first layer comprising a plurality of wires formed of steel having a carbon content in the range of 0.05 wt % to 0.2 wt %; and a second layer of wires arranged around the first layer, the second layer comprising a plurality of wires formed of steel having a carbon content in the range of 0.05 wt % to 0.2 wt %.

2. A wire strand according to claim 1, wherein at least some of the wires in each layer are formed of steel having a carbon content that is different to the carbon content of the steel forming at least one wire of the same layer.

3. A wire strand according to claim 1, wherein the wires in each layer are formed of steel having the same carbon content as the carbon content of the steel forming the other wires in the same layer.

4. A wire strand according to claim 1 wherein the king wire is formed of steel having a carbon content in the range of substantially 0.35 wt % to substantially 0.6 wt %.

5. A wire strand according to claim 1, wherein the king wire is formed of steel having a carbon content in the range of 0.4 wt % to 0.6 wt %.

6. A wire strand according to claim 1, wherein the king wire has a carbon content in the range of 0.45 wt % to 0.55 wt %.

7. A wire strand according to claim 1, wherein the king wire has a carbon content in the range of 0.35 wt % to 0.4 wt %.

8. A wire strand according to claim 1, wherein the first layer comprises a plurality of wires formed of steel having a carbon content of 0.06 wt %.

9. A wire strand according to claim 1, wherein the first layer comprises a plurality of wires formed of steel having a carbon content in the range of 0.15 wt % to 0.2 wt %.

10. A wire strand according to claim 1, wherein the first layer comprises a plurality of wires formed of steel having a carbon content of 0.18 wt %.

11. A wire strand according to claim 1, wherein the second layer comprises a plurality of wires formed of steel having a carbon content in the range of 0.15 wt % to 0.2 wt %.

12. A wire strand according to claim 1, wherein the second layer comprises a plurality of wires formed of steel having a carbon content of 0.18 wt %.

13. A wire strand according to claim 1, wherein the carbon content of the steel forming the wires in the first layer is substantially the same for all the wires in the first layer, and wherein the carbon content of the steel forming the wires in the second layer is the same for all the wires in the second layer.

14. A wire strand according to claim 1, wherein the king wire has a diameter in the range of 0.2 mm to 2 mm.

15. A wire strand according to claim 1, wherein the tensile strength of the king wire is between 1,650 $N/mm^2$ and 1,950 $N/mm^2$.

16. A wire strand according to claim 1, wherein the tensile strength of each of the wires in the first layer is between 950 $N/mm^2$ and 1,600 $N/mm^2$.

17. A wire strand according to claim 1, wherein the tensile strength of each of the wires in the second layer is between 950 $N/mm^2$ and 1,600 $N/mm^2$.

18. A wire strand according to claim 1, wherein each of the wires in the first layer has a diameter in the range of 0.2 mm to 2 mm, and wherein each of the wires in the second layer has a diameter in the range of 0.2 mm to 2 mm.

19. A wire strand according to claim 1, wherein at least one of the wires in the wire strand is galvanized with zinc or zinc aluminum.

20. A wire strand according to claim 1, wherein at least one of the wires is coated with a plastics material.

* * * * *